US006369286B1

(12) United States Patent
O'Rear

(10) Patent No.: US 6,369,286 B1
(45) Date of Patent: Apr. 9, 2002

(54) CONVERSION OF SYNGAS FROM FISCHER-TROPSCH PRODUCTS VIA OLEFIN METATHESIS

(75) Inventor: Dennis J. O'Rear, Petaluma, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

(21) Appl. No.: 09/517,370

(22) Filed: Mar. 2, 2000

(51) Int. Cl.[7] ..... C07C 6/00
(52) U.S. Cl. ..... 585/644; 585/643; 585/324
(58) Field of Search ..... 585/643, 644, 585/324, 254

(56) References Cited

U.S. PATENT DOCUMENTS

| | | | | |
|---|---|---|---|---|
| 2,405,996 A | * | 8/1946 | Burk | 208/114 |
| 2,662,090 A | | 12/1953 | Scharmann | |
| 2,686,195 A | | 8/1954 | McAdams et al. | |
| 2,735,862 A | | 2/1956 | Buchmann et al. | |
| 2,850,515 A | | 9/1958 | Riblett et al. | |
| 3,634,538 A | * | 1/1972 | Steffgen | 585/644 |
| 3,668,268 A | | 6/1972 | Mulaskey | |
| 3,723,562 A | * | 3/1973 | Heckelsberg | 585/324 |
| 3,726,938 A | * | 4/1973 | Berger | 585/314 |
| 3,763,032 A | * | 10/1973 | Banks | 208/93 |
| 3,852,207 A | | 12/1974 | Stangeland et al. | |
| 3,856,876 A | | 12/1974 | Burnett | |
| 3,904,513 A | | 9/1975 | Fischer et al. | |
| 4,013,733 A | | 3/1977 | Rausch | |
| 4,039,302 A | | 8/1977 | Khera | |
| 4,042,614 A | | 8/1977 | Vannice et al. | |
| 4,046,715 A | | 9/1977 | Wilhelm | |
| 4,077,995 A | | 3/1978 | Khera | |
| 4,088,671 A | | 5/1978 | Kobylinski | |
| 4,101,593 A | | 7/1978 | Hayes et al. | |
| 4,124,649 A | | 11/1978 | Rausch | |
| 4,148,833 A | | 4/1979 | Antos | |
| 4,151,190 A | | 4/1979 | Murchison et al. | |
| 4,157,294 A | | 6/1979 | Iwao et al. | |
| 4,171,320 A | | 10/1979 | Vannice et al. | |
| 4,255,605 A | * | 3/1981 | Dixon | 585/332 |
| 4,347,121 A | | 8/1982 | Mayer et al. | |
| 4,401,556 A | | 8/1983 | Bezman et al. | |
| 4,544,674 A | | 10/1985 | Fiato et al. | |
| 4,579,986 A | | 4/1986 | Sie | |
| 4,810,357 A | | 3/1989 | Chester et al. | |
| 4,820,402 A | | 4/1989 | Partridge et al. | |
| 4,913,799 A | | 4/1990 | Gortsema et al. | |
| 4,920,691 A | * | 5/1990 | Fainman | 44/389 |
| 5,059,567 A | | 10/1991 | Linsten et al. | |
| 5,073,530 A | | 12/1991 | Bezman et al. | |
| 5,096,883 A | | 3/1992 | Mercer et al. | |
| 5,114,563 A | | 5/1992 | Lok et al. | |
| 5,189,012 A | | 2/1993 | Patel et al. | |
| 5,198,203 A | | 3/1993 | Kresge et al. | |
| 5,200,101 A | | 4/1993 | Hsu et al. | |
| 5,246,689 A | | 9/1993 | Beck et al. | |
| 5,334,368 A | | 8/1994 | Beck et al. | |
| 5,348,982 A | | 9/1994 | Herbolzheimer et al. | |
| 5,898,023 A | | 4/1999 | Francisco et al. | |

FOREIGN PATENT DOCUMENTS

GB 2 050 859 A 1/1981

OTHER PUBLICATIONS

Amelse, J., et al., *Journal of Catalysis,* "Iron Alloy Fisher-Tropsch Catalysts", 72: pp. 95–110 (1981) Academic Press, New York.

Atterer, M., et al., Gmelins Handbuch der Anorganische Chemie 8. *Auflage,* 59. (1959) Verlag Chemie, GmbH, Germany.

ASTM D 975–98b, "Standard Specifications for Diesel Fuel Oils", (2000) ASTM, West Conshohocken, PA.

ASTM D 1655–99a, "Standard Specification for Aviation Turbine Fuels," (2000) ASTM, West Conshohocken, PA.

Beck, J., et al., *J. American Chemical Society,* "A New Family of Mesoporous Molecular Sieves Prepared with Liquid Crystal Templates", 114, No. 27: pp. 10834–10843 (1992) American Chemical Society, Washington, D.C.

Courty, P. and Delmon, B., "*C.R. Acad. Sc. Paris,*" p. 268 (May 28, 1969) Centre National de la Recherche Scientifique, Paris.

Deckwer, W. and Serpemen, Y., *Ind. Eng. Chem. Process Des. Dev.,* "Modeling the Fischer–Tropsch Synthesis in the Slurry Phase," 21: No. 2, pp. 231–241 (1982) American Chemical Society, Washington, D.C.

Hepp, H., et al., *Ind. Eng. Chem.,* "Ultilization of Kerosene Stocks for Jet Fuels by Treatment with Urea," 45: 112 (1953) American Chemical Society, Washington, D.C.

Hu, Y., *Hydrocarbon Processing,* "Unconventional olefin processes", May 1983, pp. 89–96.

Khan, M., et al., AICHE 1981 Summer National Meeting No. 408, "The Synthesis of Light Hydrocarbons from CO & H2 Mixtures over Selected Metal Catalysts", ACS 173rd Symposium, Fuel Div., New Orleans, Mar. 1977, American Chemical Society, Washington, D.C.

(List continued on next page.)

*Primary Examiner*—Walter D. Griffin
(74) *Attorney, Agent, or Firm*—Burns, Doane, Swecker & Mathis, LLP.

(57) ABSTRACT

A process for preparing distillate fuel compositions from a $C_{2-6}$ olefinic fraction and a $C_{20}$+ fraction via molecular averaging is described. The fractions can be obtained, for example, from Fischer-Tropsch reactions, and/or obtained from the distillation or other processing of crude oil. Molecular averaging converts the fractions to a product that includes a significant fraction in the $C_{5-20}$ range that can be used for preparing a distillate fuel composition. The product is preferably isomerized to increase the octane value and lower the pour, cloud and smoke point. The product can also be hydrotreated and/or blended with suitable additives for use as a distillate fuel composition.

24 Claims, 1 Drawing Sheet

OTHER PUBLICATIONS

Kitzelmann, D., et al., *Chem. Ing. Tech,* "Zur selektiven Hydrierung von Kohlenmonoxid zu C2–bis C4–Olefinen", 49 (1977) No. 6, pp. 463–468, Verlag Chemie, Weinheim.
Kolbel, H. and Ralek, M., *Catal. Rev.–Sci. Eng.,* "The Fischer–Tropsch Synthesis in the Liquid Phase", 21: pp. 225–274 (1980) Marcel Dekker, Inc., New York.
Kresge, C., et al., *Nature,* "Ordered mesoporous molecular sieves synthesized by a liquid–crystal template mechanism", 359: 710–712. (1992).
Lo, C., et al., "Mossbauer and Magnetic Studies of Bifunctional Medium–Pore Zeolite–Iron Catalysts Used in Synthesis Gas Conversion," pp. 573–588. (1981) American Chemical Society, Washington, D.C.
Nakamura, M., et al., *Stud. Surf. Sci. Catal.* 7, Pt/A, pp. 432–446 (1981).
Ramachandran, et al., "Bubble Column Slurry Reactor, Three–Phase Catalytic Reactors", Chapter 10, pp. 308–332. (1983) Gordon and Broch Science Publishers, New York.
Shah, Y., et al., *AIChE Journal,* "Design Parameters Estimations for Bubble Column Reactors", 28:, No. 3, pp. 353–379 (May 1982) The American Institute of Chemical Engineers.
Schulz, R., et al., *Second World Conference on Detergents,* Montreaux, Switzerland (Oct. 1986) American Oil Chemists' Society, USA.
Stanfield, R. and Delgass, W., *Journal of Catalysis,* "Mossbauer Spectroscopy of Supported Fe–Cu Alloy Catalysts for Fischer–Tropsch Synthesis", 72: pp. 37–50 (1981) Academic Press, Inc., New York.
Van der Woude, F. and Sawatzky, G., *Physics Reports,* Mossbauer Effect in Iron and Dilute Iron Based Alloys (Section C of Physics Letters) 12 No. 5, pp. 335–374 (1974) North–Holland Publishing, Amsterdam.
Vora, B., et al, *Chemistry and Industry,* "Production of Detergent Olefins and Linear Alkylbenzenes," pp. 187–191 (1990) Society of Chemical Industry, London.

* cited by examiner

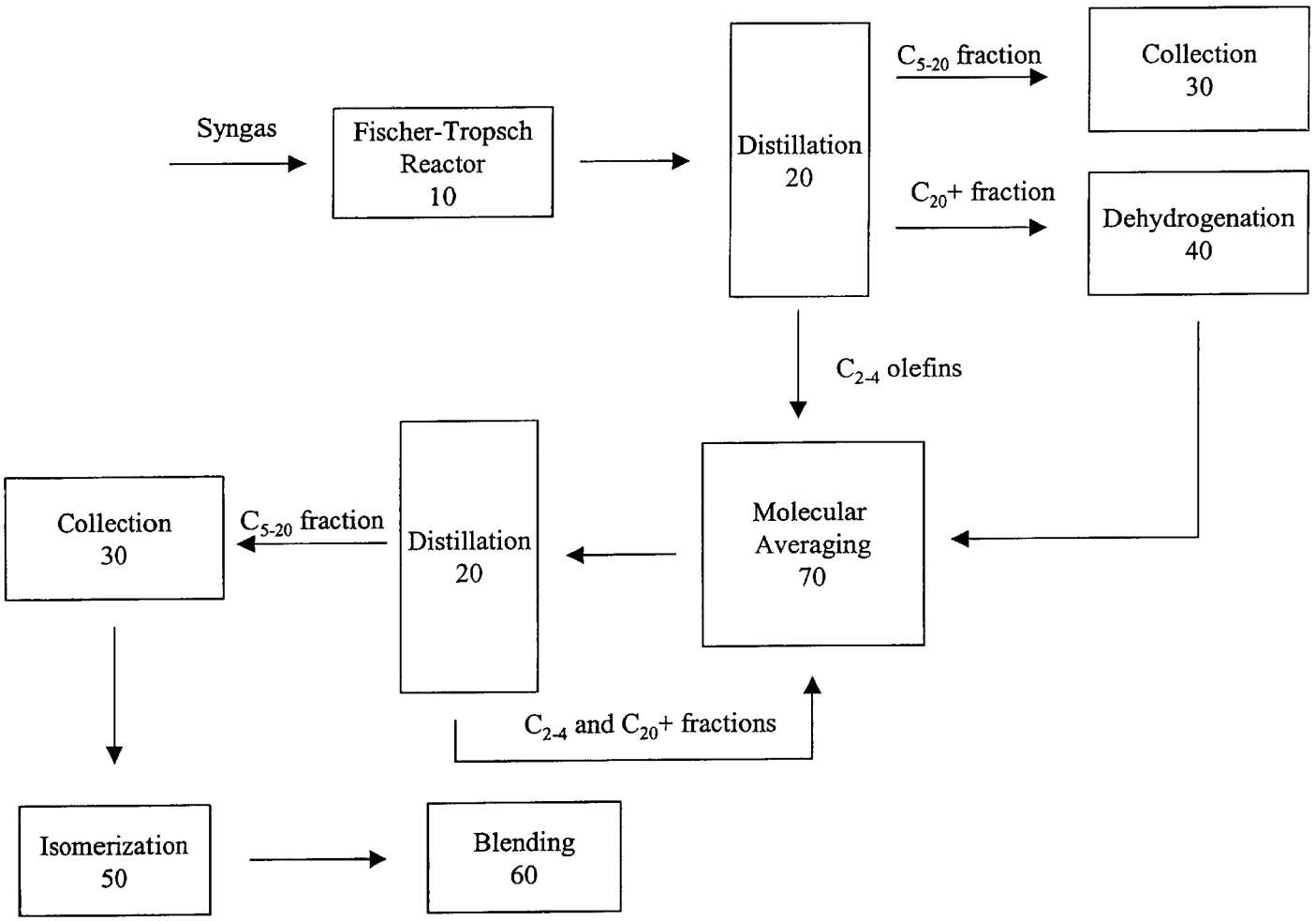
Figure

CONVERSION OF SYNGAS FROM FISCHER-TROPSCH PRODUCTS VIA OLEFIN METATHESIS

FIELD OF THE INVENTION

This invention relates to the olefination and subsequent molecular averaging of the waxy fraction resulting from Fischer-Tropsch synthesis.

BACKGROUND OF THE INVENTION

The majority of distillate fuel used in the world today is derived from crude oil. Crude oil is in limited supply, includes aromatic compounds believed to cause cancer, and contains sulfur and nitrogen-containing compounds that can adversely affect the environment. For these reasons, alternative methods for generating distillate fuel have been developed.

One alternative method for generating distillate fuel involves converting natural gas, which is mostly methane, to synthesis gas (syngas), which is a mixture of carbon monoxide and hydrogen. The syngas is converted to a range of hydrocarbon products, collectively referred to as syncrude, via Fischer-Tropsch synthesis.

It is generally possible to isolate various fractions from a Fischer-Tropsch reaction, for example, by distillation. The fractions include a gasoline fraction (B.P. about 68–450° F./20–232° C.), a middle distillate fraction (B.P. about 250–750° F./121–399° C.), a wax fraction (B.P. about 650–1200° F./343–649° C.) primarily containing $C_{20}$ to $C_{50}$ normal paraffins with a small amount of branched paraffins and a heavy fraction (B.P. above about 1200° F./649° C.) and tail gases.

An advantage of using fuels prepared from syngas is that they do not contain significant amounts of nitrogen or sulfur and generally do not contain aromatic compounds. Accordingly, they have minimal health and environmental impact.

However, a limitation associated with Fisher-Tropsch chemistry is that it tends to produce a broad spectrum of products, ranging from methane to wax. While the product stream includes a fraction useful as distillate fuel, it is not the major product.

Fischer-Tropsch products tend to have appreciable amounts of olefins in the light fractions (i.e., the naphtha and distillate fuel fractions), but less so in the heavy fractions. Depending on the specifics of the Fischer-Tropsch process, the naphtha can be expected to include more than 50% olefins, most of which are alpha olefins. Distillate fuels will also contain some level of olefins (typically between 10 and 30%) and the distillate waxy fractions can contain smaller quantities.

One approach for preparing distillate fuels is to perform Fischer-Tropsch synthesis at high alpha values that minimize the yield of light gases, and maximize the yield of heavier products such as waxes. The wax from the Fischer-Tropsch process typically causes the entire syncrude to be a solid even at high temperatures, which is not preferred. The waxes are then hydrotreated and hydrocracked to form distillate fuels. Since hydrocracking is performed at relatively high temperatures and pressures, it is relatively expensive.

It would be advantageous to provide a process which provides useful distillate fuels from Fischer-Tropsch products but which does not require a hydrocracking step. The present invention provides such a process.

SUMMARY OF THE INVENTION

In its broadest aspect, the present invention is directed to an integrated process for producing distillate fuels, including jet fuel, gasoline and diesel. The process involves the partial dehydrogenation of the wax fraction and/or heavy fraction of a Fischer-Tropsch reaction to form olefins, which are reacted with the olefins in the naphtha and/or light gas fraction of the Fischer-Tropsch reaction in the presence of an olefin metathesis catalyst. The resulting product has significantly less wax, and the product has an average molecular weight between the molecular weight of the naphtha and/or light gas fractions and the molecular weight of the wax and/or heavy fractions.

Fractions in the distillate fuel range can be isolated from the reaction mixture, for example, via fractional distillation. The product of the molecular averaging reaction tends to be highly linear, and is preferably subjected to catalytic isomerization to improve the octane values and lower the pour, cloud and freeze points. The resulting composition has relatively low sulfur values, and relatively high octane values, and can be used in fuel compositions.

In one embodiment, one or both of the feeds to the molecular averaging reaction is isomerized before the molecular averaging reaction. Incorporation of isoparaffins into the molecular averaging reaction provides a product stream that includes isoparaffins in the distillate fuel range which have relatively high octane values.

In another embodiment, the alpha olefins in the light naphtha and gas are converted into internal olefins (either normal internal or iso-internal olefins). When these materials are averaged against the internal olefins derived from dehydrogenation of the wax, the yield of intermediate fuels is increased. Furthermore, the light naphtha and gas fractions may contain impurities such as alcohols and acids. These oxygenates can be converted to additional olefins by dehydration and decarboxylation. Traces of other impurities should be reduced to acceptable levels by use of adsorbents and/or extractants.

Preferably, after performing Fischer-Tropsch synthesis on syngas, and before performing the molecular averaging reaction, hydrocarbons in the distillate fuel range are separately isolated, for example, via fractional distillation. The wax and/or heavy fraction are then dehydrogenated, the naphtha and/or light gas fractions are added to the resulting olefinic mixture, and reaction mixture is molecularly averaged by subjecting the olefins to olefin metathesis conditions.

It is preferred that the wax and/or heavy fraction and the naphtha and/or light gas fractions are derived from Fischer-Tropsch synthesis. However, at least a portion of the low molecular weight olefins or the waxy fraction can be derived from a source other than Fischer-Tropsch synthesis. Due to the nature of the molecular averaging chemistry, the reactants cannot include appreciable amounts (i.e., amounts that would adversely affect the catalyst used for molecular averaging) of thiols, amines, or cycloparaffins.

It may be advantageous to take representative samples of each fraction and subject them to molecular averaging reactions, adjusting the relative proportions of the fractions until a product with desired properties is obtained. Then, the reaction can be scaled up using the relative ratios of each of the fractions that resulted in the desired product. Using this method, one can "dial in" a molecular weight distribution which can be roughly standardized between batches and result in a reasonably consistent product.

BRIEF DESCRIPTION OF THE DRAWINGS

The FIGURE is a schematic flow diagram representing one embodiment of the invention.

DETAILED DESCRIPTION OF THE INVENTION

In its broadest aspect, the present invention is directed to an integrated process for producing distillate fuels, such as jet fuel, gasoline and diesel fuel. The process involves the partial dehydrogenation of the wax fraction and/or heavy fraction of a Fischer-Tropsch reaction mixture to form olefins, which are reacted with the olefins in the naphtha and light gas fraction of the Fischer-Tropsch reaction in the presence of an olefin metathesis catalyst. The resulting product has significantly less wax, and has an average molecular weight between the molecular weight of the naphtha and/or light gas fractions and the molecular weight of the wax and/or heavy fractions.

Hydrocarbons in the distillate fuel range can be isolated from the reaction mixture via fractional distillation. The product of the molecular averaging reaction tends to be highly linear, and is preferably subjected to catalytic isomerization to improve the octane values and lower the pour, cloud and freeze points. To maximize the yield of desired distillate fuels, the olefins in the light naphtha can first be converted to internal olefins.

In one embodiment, at least a portion of one or both of the relatively low molecular weight (for example, $C_{2-6}$) and/or relatively high molecular weight (for example, $C_{20}$+) fractions is obtained from another source, for example, via distillation of crude oil.

The process described herein is an integrated process. As used herein, the term "integrated process" refers to a process which involves a sequence of steps, some of which may be parallel to other steps in the process, but which are interrelated or somehow dependent upon either earlier or later steps in the total process.

An advantage of the present process is the effectiveness and relatively inexpensive processing costs with which the present process may be used to prepare high quality distillate fuels, and particularly with feedstocks which are not conventionally recognized as suitable sources for such fuels. An additional advantage is that the resulting fuel is highly paraffinic, and has relatively low levels of sulfur, nitrogen and polynuclear aromatic impurities.

Distillate Fuel Composition

The distillate fuel prepared according to the process described herein typically has an average molecular weight in the $C_{5-20}$ range. The molecular weight can be controlled by adjusting the molecular weight and proportions of the high molecular weight (wax and/or heavy fraction) and the low molecular weight (naphtha and/or light gas) fractions. Distillate fuel compositions with boiling points in the range of between about 68 –450° F., more preferably between about 250–370° F., are preferred. The currently most preferred average molecular weight is around $C_{8-12}$, which has a boiling point in the range of roughly 345° F., depending on the degree of branching. Specifications for the most commonly used diesel fuel (No. 2) are disclosed in ASTM D 975 (See, for example, p. 34 of 1998 Chevron Products Company Diesel Fuels Tech Review). The minimum flash point for diesel fuel is 52° C. (125° F.). Specifications for jet fuel are disclosed in ASTM D 1655, standard Specification for Aviation Turbine Fuels. The minimum flash point for jet fuel is typically 38° C.

The process is adaptable to generate higher molecular weight fuels, for example, those in the $C_{15-20}$ range, or lower molecular weight fuels, for example, those in the $C_{5-8}$ range. Preferably, the majority of the composition includes compounds within about 8, and more preferably, within about 5 carbons of the average. Another important property for the distillate fuel is that it has a relatively high flash point for safety reasons. Preferably, the flash point is above 90° C., more preferably above 110° C., still more preferably greater than 175° C., and most preferably between 175° C. and 300° C.

The distillate fuel can be used, for example, in diesel automobiles and trucks. The high paraffinic nature of the fuel gives it high oxidation and thermal stability. The fuel can also be used as a blending component with other fuels. For example, the fuel can be used as a blending component with fuels derived from crude oil or other sources.

Preferably, the reactants used in the molecular averaging reaction are obtained from Fischer-Tropsch reactions, and therefore, contain virtually no heteroatoms or aromatic compounds. Alternatively, the fuel can be obtained by molecular averaging of other feedstocks, preferably in which at least the heteroatoms, and more preferably the aromatics, have been removed.

Additives

The distillate fuel composition can include various additives, such as lubricants, emulsifiers, wetting agents, densifiers, fluid-loss additives, corrosion inhibitors, oxidation inhibitors, friction modifiers, demulsifiers, anti-wear agents, anti-foaming agents, detergents, rust inhibitors and the like. Other hydrocarbons, such as those described in U.S. Pat. No. 5,096,883 and/or U.S. Pat. No. 5,189,012, may be blended with the fuel, provided that the final blend has the necessary octanelcetane values, pour, cloud and freeze points, kinematic viscosity, flash point, and toxicity properties. The total amount of additives is preferably between 50–100 ppm by weight for 4-stroke engine fuel, and for 2-stroke engine fuel, additional lubricant oil may be added.

Diesel fuel additives are used for a wide variety of purposes; however, they can be grouped into four major categories: engine performance, fuel stability, fuel handling, and contaminant control additives.

Engine performance additives can be added to improve engine performance. Cetane number improvers (diesel ignition improvers) can be added to reduce combustion noise and smoke. 2-Ethylhexyl nitrate (EHN) is the most widely used cetane number improver. It is sometimes also called octyl nitrate. EHN typically is used in the concentration range of 0.05% mass to 0.4% mass and may yield a 3 to 8 cetane number benefit. Other alkyl nitrates, ether nitrates some nitroso compounds, and di-tertiary butyl peroxide can also be used.

Fuel and/or crankcase lubricant can form deposits in the nozzle area of injectors—the area exposed to high cylinder temperatures. Injector cleanliness additives can be added to minimize these problems. Ashless polymeric detergent additives can be added to clean up fuel injector deposits and/or keep injectors clean. These additives include a polar group that bonds to deposits and deposit precursors and a nonpolar group that dissolves in the fuel. Detergent additives are typically used in the concentration range of 50 ppm to 300 ppm. Examples of detergents and metal rust inhibitors include the metal salts of sulfonic acids, alkylphenols, sulfurized alkylphenols, alkyl salicylates, naphthenates and other oil soluble mono and dicarboxylic acids such as tetrapropyl succinic anhydride. Neutral or highly basic metal salts such as highly basic alkaline earth metal sulfonates (especially calcium and magnesium salts) are frequently used as such detergents. Also useful is nonylphenol sulfide. Similar materials made by reacting an alkylphenol with commercial sulfur dichlorides. Suitable alkylphenol sulfides can also be prepared by reacting alkylphenols with elemental sulfur. Also suitable as detergents are neutral and basic salts of phenols, generally known as phenates, wherein the phenol is generally an alkyl substituted phenolic group, where the substituent is an aliphatic hydrocarbon group having about 4 to 400 carbon atoms.

Lubricity additives can also be added. Lubricity additives are typically fatty acids and/or fatty esters. Examples of suitable lubricants include polyol esters of $C_{12}$–$C_{28}$ acids. The fatty acids are typically used in the concentration range of 10 ppm to 50 ppm, and the esters are typically used in the range of 50 ppm to 250 ppm.

Some organometallic compounds, for example, barium organometallics, act as combustion catalysts, and can be used as smoke suppressants. Adding these compounds to fuel can reduce the black smoke emissions that result from incomplete combustion. Smoke suppressants based on other metals, e.g., iron, cerium, or platinum, can also be used.

Anti-foaming additives such as organosilicone compounds can be used, typically at concentrations of 10 ppm or less. Examples of anti-foaming agents include polysiloxanes such as silicone oil and polydimethyl siloxane; acrylate polymers are also suitable.

Low molecular weight alcohols or glycols can be added to diesel fuel to prevent ice formation.

Additional additives are used to lower a diesel fuel's pour point (gel point) or cloud point, or improve its cold flow properties. Most of these additives are polymers that interact with the wax crystals that form in diesel fuel when it is cooled below the cloud point.

Drag reducing additives can also be added to increase the volume of the product that can be delivered. Drag reducing additives are typically used in concentrations below 15 ppm.

Antioxidants can be added to the distillate fuel to neutralize or minimize degradation chemistry. Suitable antioxidants include, for example, hindered phenols and certain amines, such as phenylenediamine. They are typically used in the concentration range of 10 ppm to 80 ppm. Examples of antioxidants include those described in U.S. Pat. No. 5,200,101, which discloses certain amine/hindered phenol, acid anhydride and thiol ester-derived products.

Acid-base reactions are another mode of fuel instability. Stabilizers such as strongly basic amines can be added, typically in the concentration range of 50 ppm to 150 ppm, to counteract these effects.

Metal deactivators can be used to tie up (chelate) various metal impurities, neutralizing their catalytic effects on fuel performance. They are typically used in the concentration range of 1 ppm to 15 ppm.

Multi-component fuel stabilizer packages may contain a dispersant. Dispersants are typically used in the concentration range of 15 ppm to 100 ppm.

Biocides can be used when contamination by microorganisms reaches problem levels. Preferred biocides dissolve in both the fuel and water and can attack the microbes in both phases. Biocides are typically used in the concentration range of 200 ppm to 600 ppm.

Demulsifiers are surfactants that break up emulsions and allow fuel and water phases to separate. Demulsifiers typically are used in the concentration range of 5 ppm to 30 ppm.

Dispersants are well known in the lubricating oil field and include high molecular weight alkyl succinimides being the reaction products of oil soluble polyisobutylene succinic anhydride with ethylene amines such as tetraethylene pentamine and borated salts thereof.

Corrosion inhibitors are compounds that attach to metal surfaces and form a barrier that prevents attack by corrosive agents. They typically are used in the concentration range of 5 ppm to 15 ppm. Examples of suitable corrosion inhibitors include phosphosulfurized hydrocarbons and the products obtained by reacting a phosphosulfurized hydrocarbon with an alkaline earth metal oxide or hydroxide.

Examples of oxidation inhibitors include antioxidants such as alkaline earth metal salts of alkylphenol thioesters having preferably $C_5$–$C_{12}$ alkyl side chain such as calcium nonylphenol sulfide, barium t-octylphenol sulfide, dioctylphenylamine as well as sulfurized or phosphosulfurized hydrocarbons. Additional examples include oil soluble antioxidant copper compounds such as copper salts of $C_{10-18}$ oil soluble fatty acids.

Examples of friction modifiers include fatty acid esters and amides, glycerol esters of dimerized fatty acids and succinate esters or metal salts thereof.

Pour point depressants such as $C_{8-18}$ dialkyl fumarate vinyl acetate copolymers, polymethacrylates and wax naphthalene are well known to those of skill in the art.

Examples of anti-wear agents include zinc dialkyldithiophosphate, zinc diary diphosphate, and sulfurized isobutylene.

Additional additives are described in U.S. Pat. No. 5,898,023 to Francisco et al., the contents of which are hereby incorporated by reference.

Feedstocks for the Molecular Averaging Reaction

Examples of preferred feedstocks for the molecular averaging reaction include feedstocks with an average molecular weight of $C_{2-8}$ (low molecular weight fraction) and $C_{20}$+ (high molecular weight fraction). Most preferably, the feedstocks are obtained from Fischer-Tropsch synthesis. However, numerous petroleum feedstocks, for example, those derived from crude oil, are suitable for use. Examples include gas oils and vacuum gas oils, residuum fractions from an atmospheric pressure distillation process, solvent-deasphalted petroleum residues, shale oils, cycle oils, petroleum and slack wax, waxy petroleum feedstocks, NAO wax, and waxes produced in chemical plant processes. Straight chain n-paraffins either alone or with only slightly branched chain paraffins having 20 or more carbon atoms are sometimes referred to herein as waxes.

Depending on the olefin metathesis catalysts, the feedstocks may need to exclude appreciable amounts of heteroatoms, diolefins, alkynes or saturated $C_6$ cyclic compounds. If any heteroatoms or saturated $C_6$ cyclic compounds are present in the feedstock, they may have to be removed before the molecular averaging reaction. Heteroatoms, diolefins and alkynes can be removed by hydrotreating. Saturated cyclic hydrocarbons can be separated from the desired feedstock paraffins by adsorption with molecular sieves or by deoiling or by complexing with urea.

Preferred petroleum distillates for use in the relatively low molecular weight ($C_{5-6}$ or less) fraction boil in the normal boiling point range of about 80° C. or less. Suitable feedstocks for use in the high molecular weight fraction include any highly paraffinic stream, such as waxes and partially refined waxes (slack waxes). The feedstock may have been subjected to a hydrotreating and/or hydrocracking process before being supplied to the present process. Alternatively, or in addition, the feedstock may be treated in a solvent extraction process to remove aromatics and sulfur- and nitrogen-containing molecules before being dewaxed.

As used herein, the term "waxy petroleum feedstocks" includes petroleum waxes. The feedstock employed in the process of the invention can be a waxy feed which contains greater than about 50% wax, and in some embodiments, even greater than about 90% wax. Such feeds can contain greater than about 70% paraffinic carbon, and in some embodiments, even greater than about 90% paraffinic carbon.

Examples of additional suitable feeds include waxy distillate stocks such as gas oils, lubricating oil stocks, synthetic oils and waxes such as those produced by Fischer-Tropsch synthesis, high pour point polyalphaolefins, foots oils, synthetic waxes such as normal alpha-olefin waxes, slack waxes, deoiled waxes and microcrystalline waxes. Foots oil is prepared by separating oil from the wax, where the isolated oil is referred to as foots oil.

Fischer-Tropsch Chemistry

Preferably, the light gas/naphtha and the wax/heavy fractions are obtained via Fischer-Tropsch chemistry. Fischer-Tropsch chemistry tends to provide a wide range of products from methane and other light hydrocarbons to heavy wax. Syngas is converted to liquid hydrocarbons by contact with a Fischer-Tropsch catalyst under reactive conditions. Depending on the quality of the syngas, it may be desirable to purify the syngas prior to the Fischer-Tropsch reactor to remove carbon dioxide produced during the syngas reaction and any sulfur compounds, if they have not already been removed. This can be accomplished by contacting the syngas with a mildly alkaline solution (e.g., aqueous potassium carbonate) in a packed column.

In general, Fischer-Tropsch catalysts contain a Group VIII transition metal on a metal oxide support. The catalyst may also contain a noble metal promoter(s) and/or crystalline molecular sieves. Pragmatically, the two transition metals that are most commonly used in commercial Fischer-Tropsch processes are cobalt or iron. Ruthenium is also an effective Fischer-Tropsch catalyst but is more expensive than cobalt or iron. Where a noble metal is used, platinum and palladium are generally preferred. Suitable metal oxide supports or matrices which can be used include alumina, titania, silica, magnesium oxide, silica-alumina, and the like, and mixtures thereof.

Although Fischer-Tropsch processes produce a hydrocarbon product having a wide range of molecular sizes, the selectivity of the process toward a given molecular size range as the primary product can be controlled to some extent by the particular catalyst used. In the present process, it is preferred to produce $C_{20}$–$C_{50}$ paraffins as the primary product, and therefore, it is preferred to use a cobalt catalyst, although iron catalysts may also be used. One suitable catalyst that can be used is described in U.S. Pat. No. 4,579,986 as satisfying the relationship:

$$(3+4R)>L/S>(0.3+0.4R),$$

wherein:

L=the total quantity of cobalt present on the catalyst, expressed as mg

Co/ml catalyst,

S=the surface area of the catalyst, expressed as $m^2$/ml catalyst, and

R=the weight ratio of the quantity of cobalt deposited on the catalyst by kneading to the total quantity of cobalt present on the catalyst.

Preferably, the catalyst contains about 3–60 ppw cobalt, 0.1–100 ppw of at least one of zirconium, titanium or chromium per 100 ppw of silica, alumina, or silica-alumina and mixtures thereof. Typically, the synthesis gas will contain hydrogen, carbon monoxide and carbon dioxide in a relative mole ratio of about from 0.25 to 2 moles of carbon monoxide and 0.01 to 0.05 moles of carbon dioxide per mole of hydrogen. It is preferred to use a mole ratio of carbon monoxide to hydrogen of about 0.4 to 1, more preferably 0.5 to 0.7 moles of carbon monoxide per mole of hydrogen with only minimal amounts of carbon dioxide; preferably less than 0.5 mole percent carbon dioxide.

The Fischer-Tropsch reaction is typically conducted at temperatures between about 300° F. and 700° F. (149° C. to 371° C.), preferably, between about 400° F. and 550° F. (204° C. to 228° C.). The pressures are typically between about 10 and 500 psia (0.7 to 34 bars), preferably between about 30 and 300 psia (2 to 21 bars). The catalyst space velocities are typically between about from 100 and 10,000 cc/g/hr., preferably between about 300 and 3,000 cc/g/hr.

The reaction can be conducted in a variety of reactors for example, fixed bed reactors containing one or more catalyst beds, slurry reactors, fluidized bed reactors, or a combination of different type reactors.

In a preferred embodiment, the Fischer-Tropsch reaction is conducted in a bubble column slurry reactor. In this type of reactor synthesis gas is bubbled through a slurry that includes catalyst particles in a suspending liquid. Typically, the catalyst has a particle size of between 10 and 110 microns, preferably between 20 and 80 microns, more preferably between 25 and 65 microns, and a density of between 0.25 and 0.9 g/cc, preferably between 0.3 and 0.75 g/cc. The catalyst typically includes one of the aforementioned catalytic metals, preferably cobalt on one of the aforementioned catalyst supports when formation of $C_{20}$+ wax fractions is desired. Preferably, such a catalyst comprises about 10 to 14 percent cobalt on a low density fluid support, for example alumina, silica and the like having a density within the ranges set forth above for the catalyst. Since the catalyst metal may be present in the catalyst as oxides, the catalyst is typically reduced with hydrogen prior to contact with the slurry liquid. The starting slurry liquid is typically a heavy hydrocarbon with a viscosity (typically a viscosity between 4–100 centistokes at 100° C.) sufficient to keep the catalyst particles suspended. The slurry liquid also has a low enough volatility to avoid vaporization during operation (typically an initial boiling point range of between about 350° C. and 550° C.). The slurry liquid is preferably essentially free of contaminants such as sulfur, phosphorous or chlorine compounds. Initially, it may be desirable to use a synthetic hydrocarbon fluid such as a synthetic olefin oligomer as the slurry fluid.

The slurry typically has a catalyst concentration of between about 2 and 40 percent catalyst, preferably between about 5 and 20 percent, and more preferably between about 7 and 15 percent catalyst based on the total weight of the catalyst, i.e., metal plus support. The syngas feed typically has a hydrogen to carbon monoxide mole ratio of between about 0.5 and 4 moles of hydrogen per mole of carbon monoxide, preferably between about 1 and 2.5 moles, and more preferably between about 1.5 and 2 moles.

The bubble slurry reactor is typically operated at temperatures within the range of between about 150° C. and 300° C., preferably between about 185° C. and 265° C., and more preferably between about 21° C. and 230° C. The pressures are within the range of between about 1 and 70 bar, preferably between about 6 and 35 bar, and most preferably between about 10 and 30 bar (1 bar=14.5 psia). Typical synthesis gas linear velocity ranges in the reactor are from about 2 to 40 cm per sec., preferably from about 6 to 10 cm per sec. Additional details regarding bubble column slurry reactors can be found, for example, in Y. T. Shah et al., "Design Parameters Estimations for Bubble Column Reactors", *AIChE Journal*, 28 No. 3, pp. 353–379 (May 1982); Ramachandran et al., "Bubble Column Slurry Reactor, Three-Phase Catalytic Reactors", Chapter 10, pp. 308–332, Gordon and Broch Science Publishers (1983); Deckwer et al., "Modeling the Fischer-Tropsch Synthesis in the Slurry Phase", *Ind. Eng. Chem. Process Des. Dev.*, v 21, No. 2, pp. 231–241 (1982); Kölbel et al., "The Fischer-Tropsch Synthesis in the Liquid Phase", *Catal Rev.-Sci. Eng.*, v. 21(n), pp. 225–274 (1980); and U.S. Pat. No. 5,348,982, the contents of each of which are hereby incorporated by reference in their entirety.

The relatively high (for example, $C_{20}$+) and relatively low (for example, $C_{2-6}$) molecular weight fractions which are to be molecularly averaged are described herein in terms of a Fischer-Tropsch reaction product. However, these fractions can also be obtained through various modifications of the literal Fischer-Tropsch process by which hydrogen (or water) and carbon monoxide (or carbon dioxide) are converted to hydrocarbons (e.g., paraffins, ethers, etc.) and to the products of such processes. Thus, the term Fischer-Tropsch type product or process is intended to apply to Fischer-Tropsch processes and products and the various modifications thereof and the products thereof. For example, the term is intended to apply to the Kolbel-Engelhardt process typically described by the reaction:

$$3CO+H_2O \rightarrow —CH_2— + 2CO_2$$

The molecular averaging process described combines a low molecular weight olefinic fraction ($C_{2-6}$, light gas/naphtha) and a high molecular weight fraction ($C_{20}$+, wax/heavy fraction) which is dehydrogenated to form a high molecular weight olefinic fraction prior to molecular averaging.

The two fractions can be obtained in separate Fischer-Tropsch reactions. The low molecular weight fraction can be obtained using conditions in which chain growth probabilities are relatively low to moderate, and the product of the reaction includes a relatively high proportion of low molecular weight ($C_{2-8}$) olefins and a relatively low proportion of high molecular weight ($C_{30}$+) waxes. The high molecular weight fraction can be obtained using conditions in which chain growth probabilities are relatively high, and the product of the reaction includes a relatively low proportion of low molecular weight ($C_{2-8}$) olefins and a relatively high proportion of high molecular weight ($C_{30}$+) waxes. After the wax product is dehydrogenated, it can be combined with the product of the first Fischer-Tropsch reaction for molecular averaging.

Suitable catalysts, supports and promoters for separately forming the low and high molecular weight fractions are described in detail below.

Catalysts With Low Chain Growth Probabilities

Suitable catalysts that provide relatively low (alpha values of between 0.600 and 0.700) to moderate (alpha values of between 0.700 and 0.800) chain growth probabilities tend to provide high yields of light ($C_{2-8}$) alpha olefins. Such catalysts are well known to those of skill in the art. Preferably, the catalyst used in the first stage is an iron-containing catalyst. Iron itself can be used and, when iron oxides are formed, can be reduced with hydrogen back to iron. However, because the presence of iron fines in the product stream is not preferred, and because iron oxides (rust) decrease the surface area of the catalyst available for reaction, other iron-containing catalysts are preferred. Examples of suitable iron-containing catalysts include those described in U.S. Pat. No. 4,544,674 to Fiato et al.

In a preferred embodiment, the iron catalysts include at least about 10 to about 60 weight percent iron. More preferably, they include between about 20 to about 60 weight percent iron, and most preferably about 30 to about 50 weight percent iron. These catalysts can be unsupported, but are preferably promoted with a refractory metal oxide ($SiO_2$, $Al_2O_3$, etc.), alkali (K, Na, Rb) and/or Group IB metals (Cu, Ag). These catalysts are usually calcined, but usually not reduced, rather they are brought up to reaction temperature directly in the $CO/H_2$ feed.

Co-precipitated iron-based catalysts, including those containing cobalt, can be used. High levels of cobalt in an iron-cobalt alloy are known to produce enhanced selectivity to olefinic products, as described in *Stud. Surf. Sci. Catal.* 7, Pt/A, pg. 432 (1981).

Examples of co-precipitated iron-cobalt catalysts and/or alloys include those described in U.S. Pat. Nos. 2,850,515, 2,686,195, 2,662,090, and 2,735,862; AICHE 1981 Summer Nat'l Meeting Preprint No. 408, "The Synthesis of Light Hydrocarbons from CO and $H_2$ Mixtures over Selected Metal Catalysts" ACS 173rd Symposium, Fuel Division, New Orleans, March 1977; *J. Catalysis* 1981, No. 72(1), pp. 37–50; *Adv. Chem. Ser.* 1981, 194, 573–88; *Physics Reports* (Section C of Physics Letters) 12 No. 5 (1974) pp. 335–374; UK patent application No. 2050859A; *J. Catalysis* 72, 95–110 (1981); Gmelins Handbuch der Anorganische Chemie 8, Auflage (1959), pg. 59; Hydrocarbon Processing, May 1983, pp. 88–96; and *Chem. Ing. Tech.* 49 (1977) No. 6, pp. 463–468.

Methods for producing high surface area metal oxides are described, for example, in the French article, "C. R. Acad. Sc. Paris", p. 268 (May 28, 1969) by P. Courte and B. Delmon. Metal oxides with a high surface area are prepared by evaporating to dryness aqueous solutions of the corresponding glycolic acid, lactic acid, malic or tartaric acid metal salts. One oxide that was prepared was $CoFe_2O_4$.

Iron-cobalt spinels which contain low levels of cobalt, in an iron/cobalt atomic ratio of 7:1 to 35:1, are converted to Fischer-Tropsch catalysts upon reduction and carbiding (see, for example, U.S. Pat. No. 4,544,674 to Fiato et al.). These catalysts tend to exhibit high activity and selectivity to $C_2$–$C_6$ olefins and low methane production.

Catalysts with High Chain Growth Probabilities

Catalysts that provide relatively high chain growth probabilities (alpha values of between 0.800 and 0.900) can be used to form a product that mostly includes $C_{20}$+ waxes. Any catalyst that provides relatively high chain growth probabilities can be used. Preferably, the catalyst used in the second stage is a cobalt-containing catalyst. Ruthenium is also an effective Fischer-Tropsch catalyst but is more expensive.

One suitable cobalt catalyst that can be used is described in U.S. Pat. No. 4,579,986, as satisfying the relationship:

$$(3+4R)>L/S>(0.3+0.4R),$$

wherein:

L=the total quantity of cobalt present on the catalyst, expressed as mg Co/ml catalyst;

S=the surface area of the catalyst, expressed as $m^2$/ml catalyst; and

R=the weight ratio of the quantity of cobalt deposited on the catalyst by kneading to the total quantity of cobalt present on the catalyst.

Other suitable catalysts include those described in U.S. Pat. Nos. 4,077,995, 4,039,302, 4,151,190, 4,088,671, 4,042,614 and 4,171,320. U.S. Pat. No. 4,077,995 discloses a catalyst that includes a sulfided mixture of CoO, $Al_2O_3$ and ZnO. U.S. Pat. No. 4,039,302 discloses a mixture of the oxides of Co, Al, Zn and Mo. U.S. Pat. No. 4,151,190 discloses a metal oxide or sulfide of Mo, W, Re, Ru, Ni or Pt, plus an alkali or alkaline earth metal, with Mo—K on carbon being preferred.

U.S. Pat. No. 4,088,671 discloses minimizing methane production by using a small amount of Ru on a cobalt catalyst. Examples of supported ruthenium catalysts suitable for hydrocarbon synthesis via Fischer-Tropsch reactions are disclosed, for example, in U.S. Pat. Nos. 4,042,614 and 4,171,320.

In general, the amount of cobalt catalytic metal present is about 1 to about 50 weight percent of the total catalyst composition, more preferably from about 10.0 to about 25 weight percent.

Preferably, the catalyst which provides high chain growth probabilities contains about 3–60 ppw cobalt, 0.1–100 ppw of at least one of zirconium, titanium or chromium per 100 ppw of silica, alumina, or silica-alumina and mixtures thereof.

Catalyst Supports

The type of support used can influence methane production, which should be minimized regardless of whether the catalyst used promotes high or low chain growth probabilities. Suitable metal oxide supports or matrices which can be used to minimize methane production include alumina, titania, silica, magnesium oxide, silica-alumina, and the like, and mixtures thereof. Examples include titania, zirconium titanate, mixtures of titania and alumina, mixtures of titania and silica, alkaline earth titanates, alkali titanates, rare earth titanates and mixtures of any one of the foregoing with supports selected from the group consisting of vanadia, niobia, tantala, alumina, silica and mixtures thereof.

In the case of supported ruthenium catalysts, the use of a titania or titania-containing support will result in lower methane production than, for example, a silica, alumina or manganese oxide support. Accordingly, titania and titania-containing supports are preferred.

Typically, the catalysts have a particle size of between 10 and 110 microns, preferably between 20 and 80 microns, more preferably between 25 and 65 microns, and have a density of between 0.25 and 0.9 g/cc, preferably between 0.3 and 0.75 g/cc. The catalysts typically include one of the above-mentioned catalytic metals, preferably including iron for low molecular weight olefin production and cobalt for $C_{20}$+ wax production, on one of the above-mentioned catalyst supports. Preferably, the cobalt-containing catalysts include about 10 to 14 percent cobalt on a low density fluid support, for example, alumina, silica and the like, having a density within the ranges set forth above for the catalyst.

Promoters and Noble Metals

Methane selectivity is also influenced by the choice of promoter. Alkali metal promoters are known for reducing the methane selectivities of iron catalysts. Noble metals, such as ruthenium, supported on inorganic refractory oxide supports, exhibit superior hydrocarbon synthesis characteristics with relatively low methane production. Where a noble metal is used, platinum and palladium are generally preferred. Accordingly, alkali metal promoters and/or noble metals can be included in the catalyst bed of the first stage provided that they do not significantly alter the reaction kinetics from slow chain growth probabilities to fast chain growth probabilities.

The disclosures of each of the patents discussed above are incorporated herein by reference in their entirety.

The Separation of Product from the Fischer-Tropsch Reaction

The products from Fischer-Tropsch reactions generally include a gaseous reaction product and a liquid reaction product. The gaseous reaction product includes hydrocarbons boiling below about 650° F. (e.g., tail gases through middle distillates). The liquid reaction product (the condensate fraction) includes hydrocarbons boiling above about 650° F. (e.g., vacuum gas oil through heavy paraffins).

The minus 650° F. product can be separated into a tail gas fraction and a condensate fraction, i.e., about $C_5$ to $C_{20}$ normal paraffins and higher boiling hydrocarbons, using, for example, a high pressure and/or lower temperature vapor-liquid separator or low pressure separators or a combination of separators. The preferred fractions for preparing the distillate fuel composition via molecular averaging generally include $C_{2-5}$ and $C_{20}$+ paraffins and olefins.

After removing the particulate catalyst, the fraction boiling above about 650° F. (the condensate fraction) can be separated into a wax fraction boiling in the range of about 650° F.–1200° F., primarily about containing $C_{20}$ to $C_{50}$ linear paraffins with relatively small amounts of higher boiling branched paraffins, and one or more fractions boiling above about 1200° F. However, both fractions are preferably combined for molecular averaging.

Products in the desired range (for example, $C_{5-20}$, preferably around $C_{8-12}$) are preferably isolated and used directly to prepare distillate fuel compositions. Products in the relatively low molecular weight fraction (for example, $C_{2-6}$, light gas/naphtha) and the relatively high molecular weight fraction (for example, $C_{20}$+, wax/heavy fractions) can be isolated and combined for molecular redistribution/averaging to arrive at a desired fraction. The product of the molecular averaging reaction can be distilled to provide a desired $C_{5-20}$ fraction, and also relatively low and high molecular weight fractions, which can be reprocessed in the molecular averaging stage.

More product in the desired range is produced when the reactants have molecular weights closer to the target molecular weight. Of course, following fractional distillation and isolation of the product of the molecular averaging reaction, the other fractions can be isolated and re-subjected to molecular averaging conditions.

Hydrotreating and/or Hydrocracking Chemistry

Fractions used in the molecular averaging chemistry may include heteroatoms such as sulfur or nitrogen, diolefins and alkynes that may adversely affect the catalysts used in the molecular averaging reaction. If sulfur impurities are present in the starting materials, they can be removed using means well known to those of skill in the art, for example, extractive Merox, hydrotreating, adsorption, etc. Nitrogen-containing impurities can also be removed using means well known to those of skill in the art. Hydrotreating and hydrocracking are preferred means for removing these and other impurities from the heavy wax feed component. Removal of these components from the light naphtha and gas streams must use techniques that minimize the saturation of the olefins in these streams. Extractive Merox is suitable for removing sulfur compounds and acids from the light streams. The other compounds can be removed, for example, by adsorption, dehydration of alcohols, and selective hydrogenation. Selective hydrogenation of diolefins, for example, is well known in the art. One example of a selective hydrogenation of diolefins in the presence of olefins is UOP's DeFine process.

Accordingly, it is preferred that the heavy wax fractions be hydrotreated and/or hydrocracked to remove the heteroatoms before performing the molecular averaging process described herein. Hydrogenation catalysts can be used to hydrotreat the products resulting from the Fischer-Tropsch, molecular averaging and/or isomerization reactions, although it is preferred not to hydrotreat the products from the Fischer-Tropsch reaction, since the olefins necessary for the molecular averaging step would be hydrogenated.

As used herein, the terms "hydrotreating" and "hydrocracking" are given their conventional meaning and describe processes that are well known to those skilled in the art. Hydrotreating refers to a catalytic process, usually carried out in the presence of free hydrogen, in which the primary purpose is the desulfurization and/or denitrification of the feedstock. Generally, in hydrotreating operations, cracking of the hydrocarbon molecules, i.e., breaking the larger hydrocarbon molecules into smaller hydrocarbon molecules, is minimized and the unsaturated hydrocarbons are either fully or partially hydrogenated.

Hydrocracking refers to a catalytic process, usually carried out in the presence of free hydrogen, in which the cracking of the larger hydrocarbon molecules is a primary purpose of the operation. Desulfurization and/or denitrification of the feed stock usually will also occur.

Catalysts used in carrying out hydrotreating and hydrocracking operations are well known in the art. See, for example, U.S. Pat. Nos. 4,347,121 and 4,810,357 for general descriptions of hydrotreating, hydrocracking, and typical catalysts used in each process.

Suitable catalysts include noble metals from Group VIIIA, such as platinum or palladium on an alumina or siliceous matrix, and unsulfided Group VIIIA and Group VIB, such as nickel-molybdenum or nickel-tin on an alumina or siliceous matrix. U.S. Pat. No. 3,852,207 describes suitable noble metal catalysts and mild hydrotreating conditions. Other suitable catalysts are described, for example, in U.S. Pat. Nos. 4,157,294 and 3,904,513. The non-noble metal (such as nickel-molybdenum) hydrogenation metal are usually present in the final catalyst composition as oxides, or more preferably or possibly, as sulfides when such compounds are readily formed from the particular metal involved. Preferred non-noble metal catalyst compositions contain in excess of about 5 weight percent, preferably about 5 to about 40 weight percent molybdenum and/or tungsten, and at least about 0.5, and generally about 1 to about 15 weight percent of nickel and/or cobalt determined as the corresponding oxides. The noble metal (such as platinum) catalyst contains in excess of 0.01 percent metal, preferably between 0.1 and 1.0 percent metal. Combinations of noble metals may also be used, such as mixtures of platinum and palladium.

The hydrogenation components can be incorporated into the overall catalyst composition by any one of numerous procedures. The hydrogenation components can be added to matrix component by co-mulling, impregnation, or ion exchange and the Group VI components, i.e., molybdenum and tungsten can be combined with the refractory oxide by impregnation, co-mulling or co-precipitation. Although these components can be combined with the catalyst matrix as the sulfides, that may not be preferred, as the sulfur compounds may interfere with some molecular averaging or Fischer-Tropsch catalysts.

The matrix component can be of many types including some that have acidic catalytic activity. Ones that have activity include amorphous silica-alumina or may be a zeolitic or non-zeolitic crystalline molecular sieve. Examples of suitable matrix molecular sieves include zeolite Y, zeolite X and the so-called ultra stable zeolite Y and high structural silica:alumina ratio zeolite Y such as that described in U.S. Pat. Nos. 4,401,556, 4,820,402 and 5,059,567. Small crystal size zeolite Y, such as that described in U.S. Pat. No. 5,073,530, can also be used. Non-zeolitic molecular sieves which can be used include, for example, silicoaluminophosphates (SAPO), ferroaluminophosphate, titanium aluminophosphate, and the various ELAPO molecular sieves described in U.S. Pat. No. 4,913,799 and the references cited therein. Details regarding the preparation of various non-zeolite molecular sieves can be found in U.S. Pat. Nos. 5,114,563 (SAPO); U.S. Pat. No. 4,913,799 and the various references cited in U.S. Pat. No. 4,913,799. Mesoporous molecular sieves can also be used, for example, the M41S family of materials (*J. Am. Chem. Soc.* 1992, 114, 10834–10843), MCM-41 (U.S. Pat. Nos. 5,246,689, 5,198,203 and 5,334,368), and MCM-48 (Kresge et al., *Nature* 359 (1992) 710).

Suitable matrix materials may also include synthetic or natural substances as well as inorganic materials such as clay, silica and/or metal oxides such as silica-alumina, silica-magnesia, silica-zirconia, silica-thoria, silica-berylia, silica-titania as well as ternary compositions, such as silica-alumina-thoria, silica-alumina-zirconia, silica-alumina-magnesia, and silica-magnesia zirconia. The latter may be either naturally occurring or in the form of gelatinous precipitates or gels including mixtures of silica and metal oxides. Naturally occurring clays which can be composited with the catalyst include those of the montmorillonite and kaolin families. These clays can be used in the raw state as originally mined or initially subjected to calumniation, acid treatment or chemical modification.

Furthermore, more than one catalyst type may be used in the reactor. The different catalyst types can be separated into layers or mixed. Typical hydrotreating conditions vary over a wide range. In general, the overall LHSV is about 0.25 to 2.0, preferably about 0.5 to 1.0. The hydrogen partial pressure is greater than 200 psia, preferably ranging from about 500 psia to about 2000 psia. Hydrogen recirculation rates are typically greater than 50 SCF/Bbl, and are preferably between 1000 and 5000 SCF/Bbl. Temperatures range from about 300° F. to about 750° F., preferably ranging from 450° F. to 600° F.

The contents of each of the patents and publications referred to above are hereby incorporated by reference in its entirety.

Molecular Redistribution/Averaging

As used herein, "molecular redistribution" is a process in which a mixture of olefins with a relatively wide size distribution is converted into an olefin stream with a relatively narrow size distribution. The terms "molecular averaging" and "disproportionation" are also used herein to describe molecular averaging.

In the process described herein, a high molecular weight wax fraction is partially dehydrogenated and combined with low molecular weight olefins. The combined olefins are then subjected to olefin metathesis conditions.

A typical dehydrogenation/hydrogenation catalyst includes a platinum component and a typical metathesis catalyst includes a tungsten component. Examples of suitable catalysts are described in U.S. Pat. No. 3,856,876, the entire disclosure of which is herein incorporated by reference. The individual steps in the overall molecular averaging reaction are discussed in detail below.

Dehydrogenation

The catalyst used to dehydrogenate the relatively high molecular weight paraffin fraction must have dehydrogenation activity. It is necessary to convert at least a portion of the paraffins in the relatively high molecular weight feed to olefins, which are believed to be the actual species that undergo olefin metathesis.

Platinum and palladium or the compounds thereof are preferred for inclusion in the dehydrogenation/ hydrogenation component, with platinum or a compound thereof being especially preferred. As noted previously, when referring to a particular metal in this disclosure as being useful in the present invention, the metal may be present as elemental metal or as a compound of the metal. As discussed above, reference to a particular metal in this disclosure is not intended to limit the invention to any particular form of the metal unless the specific name of the compound is given, as in the examples in which specific compounds are named as being used in the preparations.

The dehydrogenation step can be conducted by passing the linear paraffin feed over a dehydrogenation catalyst under dehydrogenating reaction conditions. The dehydrogenation is typically conducted in the presence of hydrogen and correspondingly a certain percentage of oxygenates, e.g., linear alcohols, will be hydrogenated to the corresponding paraffins and then dehydrogenated to the corresponding internal olefins. Thus, the linear hydrocarbon feed may contain a substantial amount of linear oxygenates. On a mole percent basis, this may be up to about 50 mol. % linear oxygenates although it is preferably less than 30 mol. %. On a weight percent basis of oxygen, this will generally be much less, because the linear hydrocarbons are typically made up of only one or two oxygen atoms per molecule.

In order to reduce or eliminate the amount of diolefins produced or other undesired by-products, the reaction conversion to internal olefins should preferably not exceed 50% and more preferably should not exceed 30% based on the linear hydrocarbon content of the feed. Preferably, the minimum conversion should be at least 15 wt. % and more preferably at least 20 wt. %.

Because of the low dehydrogenation conversions, feedstocks with a higher proportion of linear hydrocarbons having carbon atom numbers in the upper range of the desired normal alpha olefin (NAO) products are preferred to facilitate separation of the desired NAO's based on boiling point differences between the NAO and unreacted paraffins. Preferably, the final carbon numbers in the NAO product are within 50 carbon atoms of the initial carbon numbers in the linear paraffinic hydrocarbon feed. More preferably, the final carbon numbers are within 25 carbon atoms, and most preferably within 10 carbon atoms.

The dehydrogenation is typically conducted at temperatures between about 500° F. and 1000° F. (260° C. and 538° C.), preferably between about 600° F. and 800° F. (316° C. and 427° C.). The pressures are preferably between about 0.1 and 10 atms, more preferably between about 0.5 and 4 atms absolute pressure (about 0.5 to 4 bars). The LHSV (liquid hourly space velocity) is preferably between about 1 and 50 $hr^{-1}$, preferably between about 20 and 40 $hr^{-1}$. The products generally and preferably include internal olefins.

Since longer chained paraffins are more easy to dehydrogenate than shorter chained paraffins, more rigorous conditions, e.g., higher temperatures and/or lower space velocities, within these ranges are typically used where shorter chain paraffins are dehydrogenated. Conversely, lower temperatures and/or higher space velocities, within these ranges, are typically used where longer chained paraffins are dehydrogenated. The dehydrogenation is also typically conducted in the presence of a gaseous diluent, typically and preferably hydrogen. Although hydrogen is the preferred diluent, other art-recognized diluents may also be used, either individually or in admixture with hydrogen or each other, such as steam, methane, ethane, carbon dioxide, and the like. Hydrogen is preferred because it serves the dual-function of not only lowering the partial pressure of the dehydrogenatable hydrocarbon, but also of suppressing the formation of hydrogen-deficient, carbonaceous deposits on the catalytic composite. Hydrogen is typically used in amounts sufficient to insure a hydrogen to hydrocarbon feed mole ratio of about from 2:1 to 40:1, preferably in the range of about from 5:1 to 20:1.

Suitable dehydrogenation catalysts which can be used include Group VIII noble metals, e.g., iron, cobalt, nickel, palladium, platinum, rhodium, ruthenium, osmium, and iridium, preferably on an oxide support.

Less desirably, combinations of Group VIII non-noble and Group VIB metals or their oxides, e.g., chromium oxide, may also be used. Suitable catalyst supports include, for example, silica, silicalite, zeolites, molecular sieves, activated carbon alumina, silica-alumina, silica-magnesia, silica-thoria, silicaberylia, silica-titania, silica-aluminum-thora, silica-alumina-zirconia kaolin clays, montmorillonite clays and the like. In general, platinum on alumina or silicalite afford very good results in this reaction. Typically, the catalyst contains about from 0.01 to 5 wt. %, preferably 0.1 to 1 wt. % of the dehydrogenation metal (e.g., platinum). Combination metal catalysts such as those described in U.S. Pat. Nos. 4,013,733; 4,101,593 and 4,148,833, the contents of which are hereby incorporated by reference in their entirety, can also be used.

Preferably, hydrogen and any light gases, such as water vapor formed by the hydrogenation of oxygenates, or hydrogen sulfide formed by the hydrogenation of organic sulfur are removed from the reaction product prior to olefin metathesis, for example, by using one or more vapor/liquid separators. In general, where the feedstock is hydrotreated prior to the dehydrogenation, these gases will be removed by gas/liquid phase separation following the hydrotreatment. Since dehydrogenation produces a net gain in hydrogen, the hydrogen may be taken off for other plant uses or as is typically the case, where the dehydrogenation is conducted in the presence of hydrogen, a portion of the recovered hydrogen can be recycled back to the dehydrogenation reactor. Further information regarding dehydrogenation and dehydrogenation catalysts can, for example, be found in U.S. Pat. Nos. 4,046,715; 4,101,593; and 4,124,649, the contents of which are hereby incorporated by reference in their entirety. A variety of commercial processes also incorporate dehydrogenation processes, in their overall process scheme, which dehydrogenation processes may also be used in the present process to dehydrogen the paraffinic hydrocarbons. Examples of such processes include the dehydrogenation process portion of the Pacol process for manufacturing linear alkylbenzenes, described in Vora et al., *Chemistry and Industry*, 187–191 (1990); Schulz R. C. et al., Second World Conference on Detergents, Montreaux, Switzerland (October 1986); and Vora et al., Second World Surfactants Congress, Paris France (May 1988), hereby incorporated by reference in their entirety.

If desired, diolefins produced during the dehydrogenation step may be removed by known adsorption processes or selective hydrogenation processes which selectively hydrogenate diolefins to monoolefins without significantly hydrogenating monoolefins. One such selective hydrogenation process known as the DeFine process is described in the Vora et al. *Chemistry and Industry* publication cited above. If desired, branched hydrocarbons may be removed before or after the dehydrogenation process or after the olefin metathesis process described below by any suitable process, typically by adsorption. One commercial adsorption process for removing branched hydrocarbons and aromatics from linear paraffins is known as the Molex or Sorbex process described in McPhee, Petroleum Technology Quarterly, pages 127–131, (Winter 1999/2000) which description is hereby incorporated by reference.

Olefin Metathesis

The relatively low molecular weight fractions (i.e., $C_{2-6}$) and relatively high molecular weight fraction (i.e., at or above $C_{20}$) are metathesized to form a desired fraction (i.e., around $C_{5-20}$). This involves using an appropriate olefin metathesis catalyst under conditions selected to convert a significant portion of the relatively high molecular weight and relatively low molecular weight fractions to a desired fraction.

The low molecular weight olefin fraction can be used directly in the olefin metathesis reaction. As discussed above, at least a portion of the relatively high molecular weight waxy fraction must be converted into olefins in a process known as dehydrogenation or unsaturation before it can participate in the reaction. The resulting olefins are combined with the low molecular weight olefins and the reaction mixture is subjected to olefin metathesis conditions. The metathesized olefins are then optionally converted into paraffins in a process known as hydrogenation or saturation, although they can be used in distillate fuel compositions without first having been hydrogenated.

Various catalysts are known to catalyze the olefin metathesis reaction. The catalyst mass used in the olefin metathesis reaction must have olefin metathesis activity. Olefin metathesis typically uses conventional catalysts, such as $W/SiO_2$ (or inexpensive variations). Usually, the olefin metathesis catalyst will include one or more of a metal or the compound of a metal from Group VIB or Group VIIB of the Periodic Table of the Elements, which include chromium, manganese, molybdenum, rhenium and tungsten. Preferred for inclusion in the olefin metathesis component are molybdenum, rhenium, tungsten, and the compounds thereof. Particularly preferred for use in the olefin metathesis component is tungsten or a compound thereof. As discussed, the metals described above may be present as elemental metals or as compounds of the metals, such as, for example, as an oxide of the metal. It is also understood that the metals may be present on the catalyst component either alone or in combination with other metals.

The chemistry does not require using hydrogen gas, and therefore does not require relatively expensive recycle gas compressors. The chemistry is typically performed at mild pressures (100–5000 psig). The chemistry is typically thermoneutral and, therefore, there is no need for additional equipment to control the temperature.

Depending on the nature of the catalysts, olefin metathesis (and dehydrogenation) may be sensitive to impurities in the feedstock, such as sulfur- and nitrogen-containing compounds and moisture, and these must be removed prior to the reaction. Typically, if the paraffins being metathesized result from a Fischer-Tropsch reaction, they do not include an appreciable amount of sulfur. However, if the paraffins resulted from another process, for example, distillation of crude oil, they may contain sufficient sulfur impurities to adversely effect the olefin metathesis chemistry.

The presence of excess hydrogen in the olefin metathesis zone can effect the equilibrium of the olefin metathesis reaction and to deactivate the catalyst.

Since the composition of the fractions may vary, some routine experimentation will be necessary to identify the contaminants that are present and identify the optimal processing scheme and catalyst to use in carrying out the invention.

The process conditions selected for carrying out the olefin metathesis step will depend upon the olefin metathesis catalyst used. In general, the temperature in the reaction zone will be within the range of from about 400° F. (20000) to about 1000° F. (54000), with temperatures in the range of from about 500° F. (260° C.) to about 850° F. (45500) usually being preferred. In general, the conversion of the olefins by olefin metathesis increases with an increase in pressure. Therefore, the selection of the optimal pressure for carrying out the process will usually be at the highest practical pressure under the circumstances. Accordingly, the pressure in the reaction zone should be maintained above 100 psig, and preferably the pressure should be maintained above 500 psig. The maximum practical pressure for the practice of the invention is about 5000 psig. More typically, the practical operating pressure will below about 3000 psig. The feedstock to the olefin metathesis reactor should contain a minimum of olefins, and preferably should contain no added hydrogen.

Saturated and partially saturated cyclic hydrocarbons (cycloparaffins, aromatic-cycloparaffins, and alkyl derivatives of these species) can form hydrogen during the molecular averaging reaction. This hydrogen can inhibit the reaction, thus these species should be substantially excluded from the feed. The desired paraffins can be separated from the saturated and partially saturated cyclic hydrocarbons by deoiling or by use of molecular sieve adsorbents, or by deoiling or by extraction with urea. These techniques are well known in the industry. Separation with urea is described by Hepp, Box and Ray in *Ind. Eng. Chem.*, 45: 112 (1953). Fully aromatic cyclic hydrocarbons do not form hydrogen and can be tolerated. Polycyclic aromatics can form carbon deposits, and these species should also be substantially excluded from the feed. This can be done by use of hydrotreating and hydrocracking.

Tungsten catalysts are particularly preferred for carrying out the molecular averaging step, because the molecular averaging reaction will proceed under relatively mild conditions. When using the tungsten catalysts, the temperature should be maintained within the range of from about 400° F. (200° C.) to about 1000° F. (540° C.), with temperatures above about 500° F. (260° C.) and below about 800° F. being particularly desirable.

The olefin metathesis reaction described above is reversible, which means that the reaction proceeds toward a roughly thermodynamic equilibrium limit. Therefore, since the feed to the olefin metathesis zone has two streams of paraffins at different molecular weights, equilibrium will drive the reaction to produce a product stream having a molecular weight between that of the two streams. The zone in which the olefin metathesis occurs is referred to herein as an olefin metathesis zone. It is desirable to reduce the concentration of the desired products in the olefin metathesis zone to as low a concentration as possible to favor the reactions in the desired direction. As such, some routine experimentation may be necessary to find the optimal conditions for conducting the process.

In the event the catalyst deactivates with the time-on-stream, specific processes that are well known to those skilled in art are available for the regeneration of the catalysts.

Any number of reactors can be used, such as fixed bed, fluidized bed, ebulated bed, and the like. An example of a suitable reactor is a catalytic distillation reactor.

When the relatively high molecular weight and relatively low molecular weight fractions are combined, it may be advantageous to take representative samples of each fraction and subject them to olefin metathesis, while adjusting the relative amounts of the fractions until a product with desired properties is obtained. Then, the reaction can be scaled up using the relative ratios of each of the fractions that resulted in the desired product. Using this method, one can "dial in" a molecular weight distribution which can be roughly standardized between batches and result in a reasonably consistent product.

Following olefin metathesis, the olefins are optionally converted back into paraffins using a hydrogenation catalyst and hydrogen. While it is not intended that the present invention be limited to any particular mechanism, it may be helpful in explaining the choice of catalysts to further discuss the sequence of chemical reactions which are believed to be responsible for molecular averaging of the paraffins.

As an example, the following is the general sequence of reactions for ethylene and a $C_{20}$ paraffin, where the $C_{20}$ paraffin is first dehydrogenated to form an olefin and combined with ethylene, the two olefins are molecularly averaged, and, in this example, the resulting metathesized olefins are hydrogenated to form paraffins:

$$C_{20}H_{42} \leftrightarrows C_{20}H_{40} + H_2$$

$$C_{20}H_{40} + C_2H_4 2C_{11}H_{22}$$

$$C_{11}H_{22} + H_2 \leftrightarrows C_{11}H_{24}$$

Refractory Materials

In most cases, the metals in the catalyst mass (dehydrogenation and olefin metathesis) will be supported on a refractory material. Refractory materials suitable for use as a support for the metals include conventional refractory materials used in the manufacture of catalysts for use in the refining industry. Such materials include, but are not necessarily limited to, alumina, zirconia, silica, boria, magnesia, titania and other refractory oxide material or mixtures of two or more of any of the materials. The support may be a naturally occurring material, such as clay, or synthetic materials, such as silica-alumina and borosilicates. Molecular sieves, such as zeolites, also have been used as supports for the metals used in carrying out the dual functions of the catalyst mass. See, for example, U.S. Pat. No. 3,668,268. Mesoporous materials such as MCM-41 and MCM48, such as described in Kresge, C. T., et al., *Nature* (Vol. 359) pp. 710–712, 1992, may also be used as a refractory support. Other known refractory supports, such as carbon, may also serve as a support for the active form of the metals in certain embodiments. The support is preferably non-acidic, i.e., having few or no free acid sites on the molecule. Free acid sites on the support may be neutralized by means of alkali metal salts, such as those of lithium. Alumina, particularly alumina on which the acid sites have been neutralized by an alkali salt, such as lithium nitrate, is usually preferred as a support for the dehydrogenation/hydrogenation component, and silica is usually preferred as the support for the metathesis component. The preferred catalyst/support for the dehydrogenation step is Pt'silicalite, as this combination is believed to show the best resistance to fouling.

The amount of active metal present on the support may vary, but it must be at least a catalytically active amount, i.e., a sufficient amount to catalyze the desired reaction. In the case of the dehydrogenation/hydrogenation component, the active metal content will usually fall within the range from about 0.01 weight percent to about 50 weight percent on an elemental basis, with the range of from about 0.1 weight percent to about 20 weight percent being preferred. For the olefin metathesis component, the active metals content will usually fall within the range of from about 0.01 weight percent to about 50 weight percent on an elemental basis, with the range of from about 0.1 weight percent to about 25 weight percent being preferred.

Since only the $C_{20}$+ wax fraction is subjected to dehydrogenation conditions, the dehydrogenation catalyst and the olefin metathesis catalyst are typically present in separate reactors. However, for olefin metathesis catalysts which can tolerate the presence of the hydrogen generated in the dehydrogenation step, it may be possible to perform both steps in a single reactor. In a reactor having a layered fixed catalyst bed, the two components may, in such an embodiment, be separated in different layers within the bed.

If it is desirable to hydrogenate the olefins from the molecular averaging chemistry, it may be necessary to include an additional hydrogenation step in the process, since the hydrogenation of the olefins must take place after the molecular averaging step.

Isomerization Chemistry

Optionally, the fractions being molecularly averaged or the products of the molecular averaging chemistry are isomerized, so that the products have more branched paraffins, thus improving their pour, cloud and freeze points. Isomerization processes are generally carried out at a temperature between 200° F. and 700° F., preferably 300° F. to 550° F., with a liquid hourly space velocity between 0.1 and 2, preferably between 0.25 and 0.50. The hydrogen content is adjusted such that the hydrogen to hydrocarbon mole ratio is between 1:1 and 5:1. Catalysts useful for isomerization are generally bifunctional catalysts comprising a hydrogenation component (preferably selected from the Group VIII metals of the Periodic Table of the Elements, and more preferably selected from the group consisting of nickel, platinum, palladium and mixtures thereof) and an acid component. Examples of an acid component useful in the preferred isomerization catalyst include a crystalline zeolite, a halogenated alumina component, or a silica-alumina component. Such paraffin isomerization catalysts are well known in the art.

Optionally, but preferably, the resulting product is hydrogenated. The hydrogen can come from a separate hydrogen plant, can be derived from syngas, or made directly from methane and other light hydrocarbons.

After hydrogenation, which typically is a mild hydrofinishing step, the resulting distillate fuel product is highly paraffinic. Hydrofinishing is done after isomerization. Hydrofinishing is well known in the art and can be conducted at temperatures between about 190° C. to about 340° C., pressures between about 400 psig to about 3000 psig, space velocities (LHSV) between about 0.1 to about 20, and hydrogen recycle rates between about 400 and 1500 SCF/bbl.

The hydrofinishing step is beneficial in preparing an acceptably stable distillate fuels. Distillate fuels that do not receive the hydrofinishing step may be unstable in air and light due to olefin polymerization. To counter this, they may require higher than typical levels of stability additives and antioxidants.

The process will be readily understood by referring to the flow diagram in the figure. In the flow scheme contained in the figure, the process of the present invention is practiced in batch operation. However, it is possible to practice the present invention in continuous operation.

Box 10 is a reactor that reacts syngas in the presence of an appropriate Fischer-Tropsch catalyst to form Fischer-Tropsch products. These products are fractionally distilled (Box 20), and a light gas/naphtha fraction is sent to a reactor (Box 70) for molecular averaging. A $C_{5-20}$ fraction is isolated in Box 30, and a relatively high molecular weight ($C_{20}$+) fraction is sent to a reactor for dehydrogenation (Box 40), then a reactor (Box 70) for molecular averaging. Following molecular averaging, the reaction mixture is fractionally distilled (Box 20) and the desired product isolated in Box 30. Following product isolation, the product can optionally be isomerized (Box 50) and blended (Box 60) to form a desired distillate fuel composition.

The following examples will help to further illustrate the invention but are not intended to be a limitation on of the scope of the process.

EXAMPLE 1

A petroleum derived $C_{30}$–$C_{200}$ linear hydrocarbon feedstock that includes at least 70 wt. % linear paraffins with up to 50 mole % of oxygenates (e.g. linear alcohols) wax is dehydrogenated as follows. The linear hydrocarbon feed is fed to a hydrotreater containing a packed bed of platinum on alumina catalyst. Hydrogen is fed to the hydrotreater at a ratio of about 3,000 SCF per Bbl of linear hydrocarbon feed. The hydrotreater is operated at a temperature of about 600° F. to 650° F. (316° C. to 343° C.), a pressure of about 10 atm to 120 atm, and a liquid space velocity (LHSV) of about 0.5 $hr^{-}$to 1 $hr^{-1}$. The hydrotreater hydrogenates olefins and oxygenates (e.g., alcohols) in the feed to the corresponding paraffins and converts organics sulfur and nitrogen compounds to hydrogen sulfide and ammonia which are preferably removed from the liquid reaction products as gases along with hydrogen and scrubbed out of the hydrogen gas.

The entire hydrogenated product is fed to a vapor/liquid separator where the gas phase (hydrogen, ammonia, hydrogen sulfide, and any light hydrocarbons, e.g., $C_1$–$C_2$ alkanes) is separated and discharged. The hydrogenated $C_{30}$–$C_{200}$ hydrocarbon liquid phase is fed to a dehydrogenation reactor along with recycled hydrogen and, if needed, any made-up hydrogen. Hydrogen is supplied to the reactor at a ratio of about 1,000 SCF of hydrogen per barrel of hydrocarbon feed, including any recycle. The dehydrogenation reactor is a fixed bed reactor containing 0.5 wt. % platinum on alumina catalyst bed. The reactor is initially operated at a LHSV of about 40 $hr^{-1}$, a temperature of about from 700° F. to 750° F. (371° C. to 399° C.), and a pressure of about 2 atm. The conditions can be adjusted as needed to give about a 30% conversion of paraffin to internal olefins. For example, higher LHSVs and lower temperatures give lower conversions and vice versa. The entire reaction product is fed to a vapor/liquid separator where the hydrogen is taken off. A portion of the hydrogen is recycled back to the dehydrogenation reactor and the remainder can be used for other plant purposes.

The liquid reaction product is fed to a fixed bed olefin metathesis reactor containing a catalyst bed that includes a metathesis catalyst, such as tungsten on silica. Low molecular weight olefins, such as those from a Fischer-Tropsch reaction, are also fed to the reactor at a suitable mole ratio of low molecular weight olefins to wax olefins such that the average molecular weight of the reactants is in a desired range. As in the case of the dehydrogenation reaction, the reaction conditions may be adjusted as needed to provide the desired conversion.

The reaction product is fed to a fractional distillation column and a desired fraction is isolated. The product can be hydrotreated if desired, preferably using syngas or recycled hydrogen as the hydrogen source. Unreacted low molecular weight hydrocarbons and wax hydrocarbons can be recycled back to the dehydrogenation reactor and/or to the olefin metathesis reactor.

EXAMPLE 2

An integrated syngas, Fischer-Tropsch and molecular averaging process starting from natural gas is described. Impurities in natural gas are removed by passing the gas through an amine scrubber and a sulfur scrubber. The amine scrubber removes acid gases such as hydrogen sulfide, mercaptans and carbon dioxide. The sulfur scrubber contains a packed bed of zinc oxide and removes any traces of sulfur gases, e.g., hydrogen sulfide or mercaptan gases remaining in the natural gas.

The treated natural gas is fed, together with steam, to a syngas reactor where it is reacted with air or oxygen to effect partial oxidation of the methane. The fixed bed reactor contains a methane reforming, nickel-based catalyst and is operated at a temperature between 400° C. and 600° C., at a pressure of between 15 and 30 bar, and at a space velocity of about 8,000 $hr^{-1}$. The resulting syngas contains between 1.8 and 3.5 moles of hydrogen per mole of carbon monoxide. If needed, the mole ratio of hydrogen to carbon monoxide may be adjusted by using more steam, adding a carbon dioxide rich stream or passing the syngas through a membrane separator.

The syngas is fed to a Fischer-Tropsch bubble column slurry reactor containing a 12 wt. % cobalt on low density alumina catalyst with a particle size of about 25 to 65 microns and a density of about 0.4 to 7 g/cc in a 8 cs. (100° C.) synfluid slurry liquid. Before mixing with the slurry liquid, the catalyst is reduced by contact with a 5 vol. % hydrogen, 95 vol. % nitrogen gas at about 200–250° C. for about 12 hours. After contact with the hydrogen, the temperature is increased to about 350–400° C., and this temperature is maintained for about 24 hours while the hydrogen content of the gas is slowly increased until the reducing gas is essentially 100% hydrogen. The reactor is operated at a temperature between about 21° C. and 230° C., a pressure of 25–30 bar, and a synthesis gas linear velocity of about 6 to 10 cm/sec. The resulting liquid hydrocarbon product contains a high proportion of $C_{26}$ to $C_{50}$ paraffins (the wax product) and a light product boiling below about 650° F. (282° C.) containing middle distillate and tail gases. Tail gases are removed from the light fraction, for example, by using one or more liquid/gas separators operating at lower temperatures and/or pressures and the remaining light product stream (condensate) comprising $C_5$ and higher hydrocarbons boiling below 650° F. (343° C.), which are predominantly olefins, are isolated and sent to the olefin metathesis reactor.

The Fischer-Tropsch wax product is fractionated into a wax fraction boiling above about 650° F. (343° C.), primarily containing $C_{26}$–$C_{50}$ linear paraffins, a high boiling bright stock fraction boiling above about 1100° F., and a liquid fuel fraction boiling below about 650° F. The $C_{26-C50}$ linear paraffin fraction is fed to a hydrotreater. Hydrogen is furnished to the hydrotreater at a ratio of about 500 SCF per Bbl of hydrocarbon feed. The hydrotreater is a fixed bed reactor containing a 0.5 wt. % palladium on alumina catalyst. The hydrotreater is operated at a LHSV of about from 0.5 to 1 $hr^{-1}$, a temperature in the range of about 500° F. to 550° F. (260° C. to 288° C.), and a pressure of about 100–120 atms. The hydrotreater hydrogenates the oxygenates, e.g., linear alcohols, and olefins in the feed to paraffins and converts any traces of organic sulfur into hydrogen sulfide. The hydrogenated reaction product is fed to liquid/vapor separator where the excess hydrogen and any hydrogen sulfide is removed as the gaseous phase. Depending on the purity of the hydrogen phase, it may be recycled back to the hydrotreater with makeup hydrogen or may be first passed through one or more scrubbers, not shown, before being recycled or used for other plant uses. The hydrogenated liquid phase is discharged and fed to the dehydrogenation reactor along with any recycle. Hydrogen is furnished to reactor at a ratio of about 1,000 SCF of hydrogen per 1 Bbl of hydrocarbon feed including any recycle.

The dehydrogenation reactor includes a catalyst bed containing a 0.5 wt. % platinum on silicalite catalyst. The dehydrogenation reactor is initially operated at a reaction temperature of about 700° F. to 790° F. and a pressure of about 2 atm and at a LHSV of about 35 $hr^{-1}$. The conditions then adjusted as needed give a conversion of $C_{20}$–$C_{50}$ linear paraffin to internal olefin of about 30%. The dehydrogenation reaction product can be passed to a vapor/liquid phase separator where hydrogen and any light gases, e.g., water vapor generated by any trace oxygenates not hydrogenated in the hydrotreater, are discharged. The liquid product includes both internal olefins and unreacted paraffins and is sent to a molecular averaging reactor containing a 5 wt. % tungsten on silica catalyst. It is combined with low molecular weight olefins from the Fischer-Tropsch reaction.

The reaction mixture is then passed to a distillation column. Low molecular weight olefins and unreacted $C_{30}$–$C_{50}$ hydrocarbons are taken off and recycled back to either dehydrogenation reactor or, depending on the olefin content, to the molecular averaging reactor. Product in the desired range is also isolated.

While the present invention has been described with reference to specific embodiments, this application is intended to cover those various changes and substitutions that may be made by those skilled in the art without departing from the spirit and scope of the appended claims.

What is claimed is:

1. A process for preparing a distillate fuel composition, the process comprising:

(a) combining:

(i) a first hydrocarbon fraction with an average molecular weight below about $C_6$ and which includes at least 20% olefins; and (ii) a second hydrocarbon fraction with an average molecular weight above about $C_{20}$ and which includes at least 10% olefins, wherein at least a portion of the second hydrocarbon fraction is obtained via a Fischer-Tropsch process;

wherein the first and second hydrocarbon fractions are combined in a suitable proportion such that, when the molecular weights of the first and second hydrocarbon fractions are averaged, the average molecular weight is the desired molecular weight for a distillate fuel composition;

(b) subjecting the olefins in the first and second hydrocarbon fractions to olefin metathesis to provide a product comprising olefins with a desired molecular weight, and (c) isolating the product.

2. The process of claim 1, wherein the first hydrocarbon fraction with an average molecular weight below about $C_6$ is greater than 35 percent olefins.

3. The process of claim 1, wherein the first hydrocarbon fraction with an average molecular weight below about $C_6$ is greater than 50 percent olefins.

4. The process of claim 1, wherein the second hydrocarbon fraction with an average molecular weight above about $C_{20}$ is between about 25 and 50 percent olefins.

5. The process of claim 1, wherein the second hydrocarbon fraction with an average molecular weight below about $C_{20}$ is greater than 35 percent olefins.

6. The process of claim 1, wherein at least a portion of the second hydrocarbon fraction with average molecular weight above about $C_{20}$ is dehydrogenated prior to the olefin metathesis step.

7. The process of claim 1, wherein the product is isolated via fractional distillation.

8. The process of claim 1, wherein at least a portion of the product is combined with an additive selected from the group consisting of lubricants, emulsifiers, wetting agents, densifiers, fluid-loss additives, corrosion inhibitors, oxidation inhibitors, friction modifiers, demulsifiers, anti-wear agents, pour point depressants, detergents, and rust inhibitors.

9. The process of claim 1, wherein at least a portion of one or both of the first and second hydrocarbon fractions are obtained via a process other than Fischer-Tropsch chemistry and include heteroatoms, and the process further comprises hydrotreating the fraction(s) including heteroatoms to remove the heteroatoms prior to the olefin metathesis reaction.

10. The process of claim 1, further comprising isomerizing at least a portion of the product.

11. The process of claim 1, further comprising hydrogenating at least a portion of the olefins in the product.

12. The process of claim 1, wherein the product has an average molecular weight between $C_5$ and $C_{20}$.

13. The process of claim 1, wherein the product has a boiling point in the range of between 68° F. and 450° F.

14. The process of claim 1, wherein the product has a boiling point in the range of between about 250° F. and 370° F.

15. The process of claim 1, wherein at least a portion of the first hydrocarbon fraction with average molecular weight below about $C_6$ is dehydrated prior to step (b).

16. A process for preparing a distillate fuel composition, the process comprising:

(a) performing Fischer-Tropsch synthesis on syngas to provide a product stream;

(b) fractionally distilling the product stream and isolating a $C_{2-6}$ fraction and a $C_{20}$+ fraction;

(c) dehydrogenating or partially dehydrogenating the $C_{20}$+ fraction;

(d) combining the dehydrogenated or partially dehydrogenated $C_{20}$+ fraction with the $C_{2-6}$ fraction in a suitable proportion such that, when the molecular weights of the fractions are averaged, the average molecular weight is between approximately $C_5$ and $C_{20}$;

(e) subjecting the olefins in the fractions in step (d) to olefin metathesis; and (f) isolating a product in the $C_{5-20}$ range.

17. The process of claim 16, further comprising isomerizing at least a portion of the product.

18. The process of claim 16, further comprising hydrotreating at least a portion of the olefins in the product.

19. The process of claim 16, further comprising blending at least a portion of the product with one or more additional distillate fuel compositions.

20. The process of claim 16, further comprising blending at least a portion of the product with one or more additives selected from the group consisting of lubricants, emulsifiers, wetting agents, densifiers, fluid-loss additives, corrosion inhibitors, oxidation inhibitors, friction modifiers, demulsifiers, anti-wear agents, dispersants, anti-foaming agents, pour point depressants, detergents, and rust inhibitors.

21. The process of claim 16, wherein at least a portion of the $C_{2-8}$ fraction is dehydrated prior to step (e).

22. A process for preparing a distillate fuel composition, the process comprising:

(a) performing Fischer-Tropsch synthesis on syngas using a catalyst which provides low to moderate chain growth probabilities to provide a product stream including at least 5% $C_{2-8}$ olefins;

(b) performing Fischer-Tropsch synthesis on syngas using a catalyst which provides high chain growth probabilities to provide a product stream including predominantly $C_{20}$+ paraffins;

(c) dehydrogenating or partially dehydrogenating the $C_{20}$+ paraffinic product stream;

(d) combining the dehydrogenated or partially dehydrogenated $C_{20}$+ product stream with the $C_{2-8}$ product stream in a suitable proportion such that, when the molecular weights of the fractions are averaged, the average molecular weight is between approximately $C_5$ and $C_{20}$;

(e) subjecting the olefins in the fractions in step (d) to olefin metathesis; and (f) isolating a product in the $C_{5-20}$ range.

23. The process of claim 22, wherein the $C_{2-8}$ product stream from the Fischer-Tropsch synthesis step includes at least 10% olefins.

24. The process of claim 22, wherein the $C_{2-8}$ product stream from the Fischer-Tropsch synthesis step includes at least 20% olefins.

* * * * *